US007134305B2

(12) United States Patent
Wu

(10) Patent No.: US 7,134,305 B2
(45) Date of Patent: Nov. 14, 2006

(54) WIRE FEEDER DRIVING MECHANISM FOR SPRING MANUFACTURING MACHINE

(76) Inventor: David Wu, No. 66, Lane 642, Tung Wan Shou Rd., Gueishan Hsiang, Taoyuan Hsien (TW)

( * ) Notice: Subject to any disclaimer, the term of this patent is extended or adjusted under 35 U.S.C. 154(b) by 73 days.

(21) Appl. No.: 10/938,622

(22) Filed: Sep. 13, 2004

(65) Prior Publication Data

US 2006/0053853 A1 Mar. 16, 2006

(51) Int. Cl.
*B21F 35/02* (2006.01)

(52) U.S. Cl. ..... 72/144; 72/137; 72/420

(58) Field of Classification Search ..... 72/135, 72/137, 138, 140, 144, 142, 420, 421
See application file for complete search history.

(56) References Cited

U.S. PATENT DOCUMENTS 5,025,648 A * 6/1991 Matsuoka ..... 72/134
6,151,942 A * 11/2000 Itaya ..... 72/137
6,571,591 B1 * 6/2003 Itaya ..... 72/137

* cited by examiner

*Primary Examiner*—Dmitry Suhol

(57) ABSTRACT

A wire feeder driving mechanism capable of driving a wire feeder of a spring manufacturing machine to perform a three-dimensional movement. The spring manufacturing machine includes a machine base and a work table. The work table has an opening and a plurality of tool seats. The opening provides the feeding chuck of the wire feeder a moving space. The tool seat is provided to install a tool set to move back and forth on the work table. The wire feeder is assembled with a plurality of axial driving devices. The axial driving device is able to receive power and to move perpendicular to each other. The metal wire led through the wire feeder is thereby able to approach the tool seat in a three-dimensional manner. The spring manufacturing machine is therefore able to produce various complicated springs.

12 Claims, 11 Drawing Sheets

WIRE FEEDER DRIVING MECHANISM FOR SPRING MANUFACTURING MACHINE

BACKGROUND OF THE INVENTION

The present invention relates in general to a wire feeder driving mechanism for a spring manufacturing machine, and more particularly, to a mechanism which enables a spring manufacturing machine to simplify the actuating mechanism of its tool seat and thereby significantly cuts down the labor hours consumed for adjustment of the tool set of the spring manufacturing machine. The present invention enhances the easiness and the convenience of the operation of the spring manufacturing machine.

Because springs are widely utilized in the shock absorbing or shock reducing, such as for automobiles, toys, electric appliances, switches, medical utilities, and so on, they have become an indispensable part of electric or mechanical equipments. The demand of spring shape becomes more and more versatile; it is therefore cannot be satisfied by a conventional spring manufacturing machine. Accordingly, to develop a next generation product to satisfy the strong demand of the market is an important issue for persons skilled in the spring manufacturing machine.

Referring to FIG. 1, a conventional spring manufacturing machine includes a machine base 10*a* and a work table 20*a*. The machine base 10*a* is secured thereon a wire feeder 11*a* which has a wire feeding chuck 12*a* at the front end thereof. The feeding chuck 12*a* is able to output the metal wire which will be formed into a spring. The work table 20*a* has a feeder hole 21*a* formed in the middle thereof which is able to receive the feeding chuck 12*a*. A plurality of tool seats 22*a* are installed on the work table 20*a*. Each tool seat 22*a* includes a driving rod 221*a*, a rail cam 222*a*, and a tool set 223*a*. By utilizing the driving rod 221*a* and the rail cam 222*a*, the tool set 223*a* is able to perform a linear or a curve motion for bending, winding, or cutting process of the metal wire.

However, the conventional spring manufacturing machine has several radical problems. First, to reduce the manufacturing cost a spring manufacturing machine is utilized to manufacture different kind of springs. To change the manufacturing process the tool seats 22*a* secured on the work table 20*a* need to be accordingly replaced and adjusted. The replacement and adjustment of the tool seats 22*a* are so time consuming that the production efficiency and economic benefit are very low. Second, a small deviation of the material quality, the heat treating process, or the wire diameter of the metal raw material will greatly influence the nature of the spring formed. Only a professional engineer is able to perform the adjustment and calibration of the conventional spring manufacturing machine. It is, therefore, hard to control the spring product's quality. Third, to perform a curve motion of the tool set 223*a* it is conventional to further install a complicated or adjustable driving member. This auxiliary driving member not only raises the material and manufacture cost but also increases the difficulty of assembling and maintenance. Fourth, when various manufacture industries' demand for spring configuration becomes more and more complicated, the tool seats 22*a* installed on the work table 20*a* for convention are not sufficient. It is unable to satisfy modern manufacture industries' demand.

BRIEF SUMMARY OF THE INVENTION

The present invention provides a wire feeder driving mechanism for a spring manufacturing machine, which enables a wire feeder to perform a two-dimensional or a three-dimensional motion through installation of a two-dimensional driving device or a three-dimensional driving device. This invention successfully enables a spring manufacturing machine to simplify the actuating mechanism of its tool seat and thereby significantly cuts down the labor hours consumed for adjustment of the tool set of a spring manufacturing machine. The present invention enhances the easiness and the convenience of the operation and maintenance of a spring manufacturing machine.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
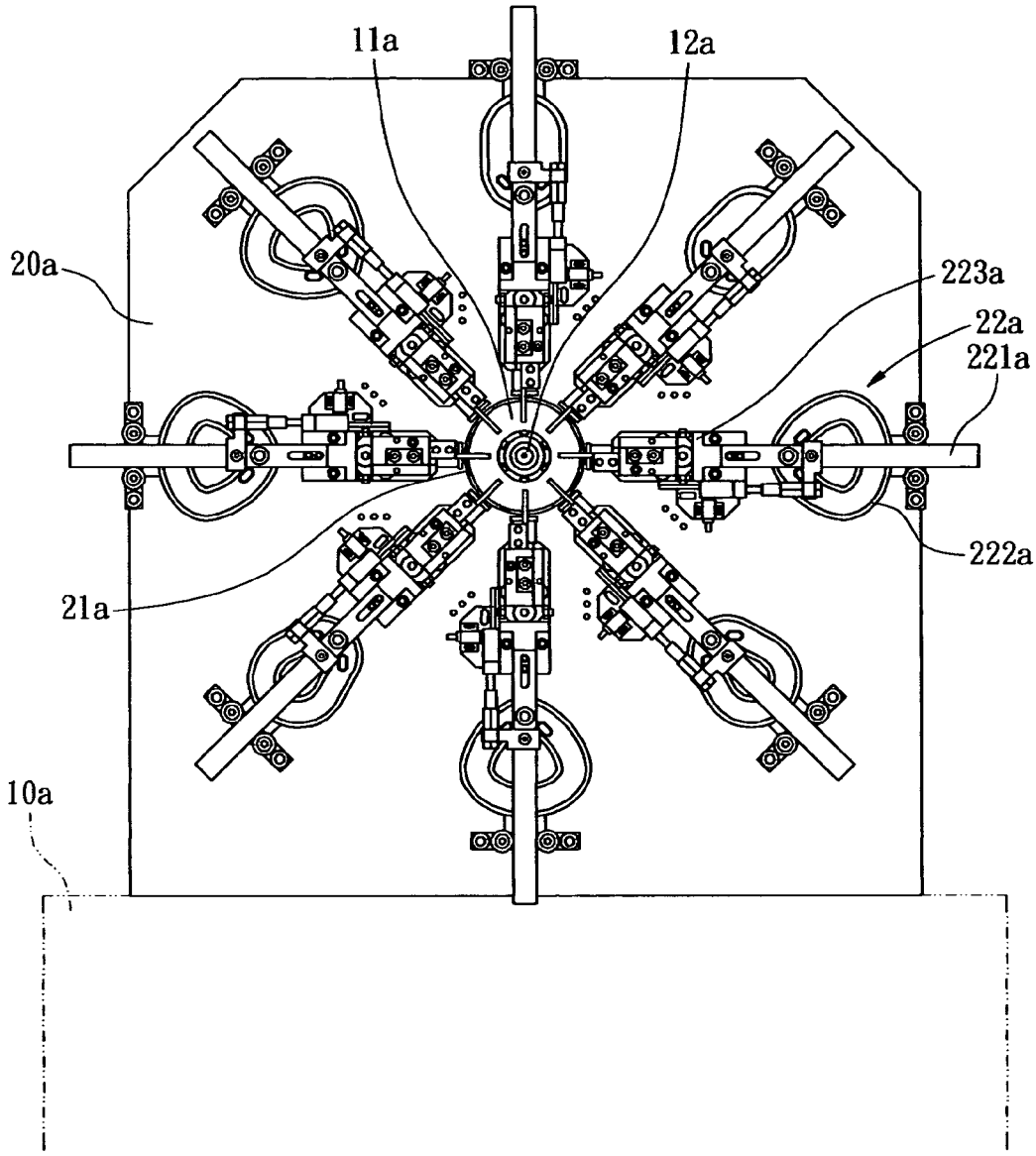
FIG. 1 PRIOR ART
FIG. 1 is a front view of a conventional spring manufacturing machine.

Reference will now be made in detail to the preferred embodiments of the present invention, examples of which are illustrated in the accompanying drawings. Wherever possible, the same reference numbers are used in the drawings and the description to refer to the same or like parts.

Figure 2:
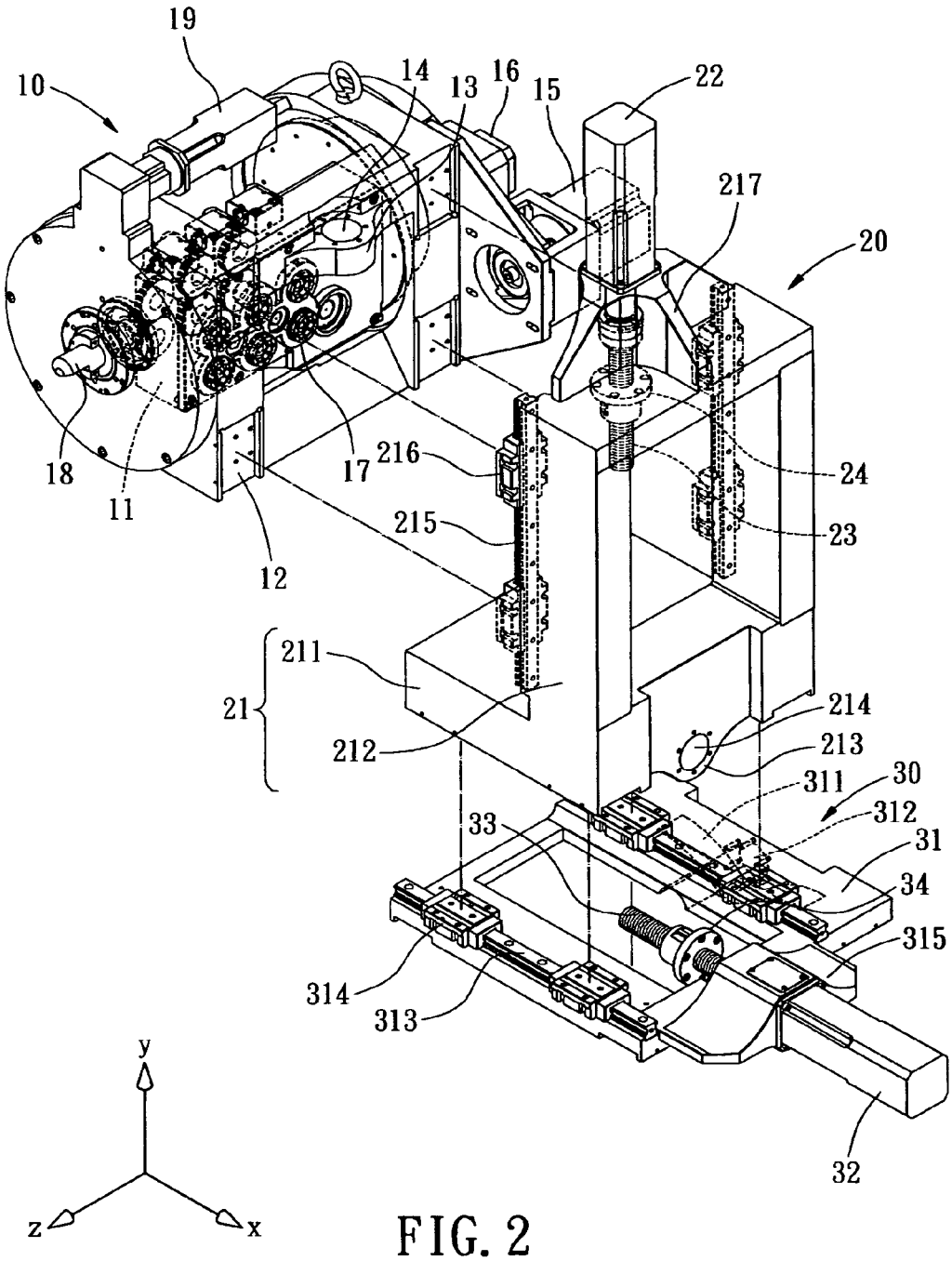
FIG. 2 is an exploded view of the first embodiment of the present invention.

Referring to FIG. 2, the present invention provides a wire feeder driving mechanism for a spring manufacturing machine. This wire feeder driving mechanism includes a wire feeder 10, a first axial driving device 20, and a second axial driving device 30. To facilitate explanation, a three dimensional Cartesian coordinate system is further designated in some figures.

The wire feeder 10 includes a feeding box 11, a reeling motor 15, a feeding motor 16, a feeding chuck 18, and a spindle rotating motor 19. The feeding box 11 has a fixing platform 12 installed at one side thereof. A shaft mount 13 extends from the fixing platform 12. A shaft hole 14 is formed at the center of the shaft mount 13. The reeling motor 15 and the feeding motor 16 are connected to the rear of the feeding box 11. The reeling motor 15 rotates a metal wire reel in order to supply the wire feeder 10 with a metal wire. The feeding motor 16 feeds forward the metal wire through the rotating of a feed roller set 17. The feeding chuck 18 has a central hole which is utilized to receive and forward the metal wire. The spindle rotating motor 19 is able to drive and rotate the feeding chuck 18, which facilitates processing the metal wire at different angles.

The first axial driving device 20 can be disposed parallel with the X axis, the Y axis, or the Z axis of the spring manufacturing machine. In the present embodiment the first driving device 20 is parallel with the Y axis of the spring manufacturing machine. The first axial driving device 20 includes a Y axis base body 21, a servo motor 22, a Y axis lead screw 23, and a flange mount 24. The Y axis base body 21 is constructed of a horizontal board 211 and a vertical frame 212, with a L-shaped configuration. A shaft mount 213 is formed at and extends from the middle of one side of the horizontal board 211. A shaft hole 214 is bored from the center of the shaft mount 213. The vertical frame 212 has parallel slide rails 215 installed at the both sides thereof. A plurality of slide blocks 216 are installed onto each slide rail 215. The slide block 216 is connected to the fixing platform 12 of the wire feeder 10. Further, a fixed brace 217 is formed at and extends from the top of the vertical frame 212. The fixed brace 217 is utilized to install the servo motor 22. The servo motor 22 has a motor shaft which is oriented toward and coupled to the Y axis lead screw 23 through a shaft coupler or other mechanical elements. The Y axis lead screw 23 is oriented parallel with the moving direction of the slide rail 215. The flange mount 24 is screwed onto the Y axis lead screw 23 with one end thereof received by the shaft hole 14 of the feeding box 11 while the other end thereof secured on the shaft mount 13 of the feeding box 11 through bolts and nuts or other means.

The second axial driving device 30 can be disposed parallel with the X axis, the Y axis, or the Z axis of the spring manufacturing machine. In the present embodiment the second driving device 30 is parallel with the X axis of the spring manufacturing machine. The moving direction of the second axial driving device 30 is thereby perpendicular to that of the first axial driving device 20. The second axial driving device 30 is secured on the spring manufacturing machine through bolts and nuts or other mechanical elements, and further assembled with the first axial driving device 20 to enable the wire feeder 10 to perform a two dimensional planar movement. The second axial driving device 30 includes a X axis base body 31, a servo motor 32, a X axis lead screw 33, and a flange mount 34. The X axis base body 31 is secured on the spring manufacturing machine through a plurality of bolts and nuts or other means. A shaft mount 311 is formed at and extends from the middle of one side of X axis base body 31. A shaft hole 312 is bored from the center of the shaft mount 311. The X axis base body 31 has parallel slide rails 313 installed thereon which are perpendicular with the direction of the shaft hole 312. A plurality of slide blocks 314 are installed onto each slide rail 313. The horizontal board 211 of the Y axis base body 21 is placed onto and connected with the slide blocks 314. Further, a fixed brace 315 is formed at and extends from one side of the X axis base body 31. The fixed brace 315 is utilized to install the servo motor 32. The servo motor 32 has a motor shaft which is oriented toward and coupled to the X axis lead screw 33 through a shaft coupler and other mechanical elements. The X axis lead screw 33 is disposed parallel with the moving direction of the slide rail 313. The flange mount 34 is screwed onto the X axis lead screw 33 with one end thereof received by the shaft hole 214 of the Y axis base body 21 while the other end thereof secured on the shaft mount 213 of the Y axis base body 21 through bolts or other means.

Figure 3:
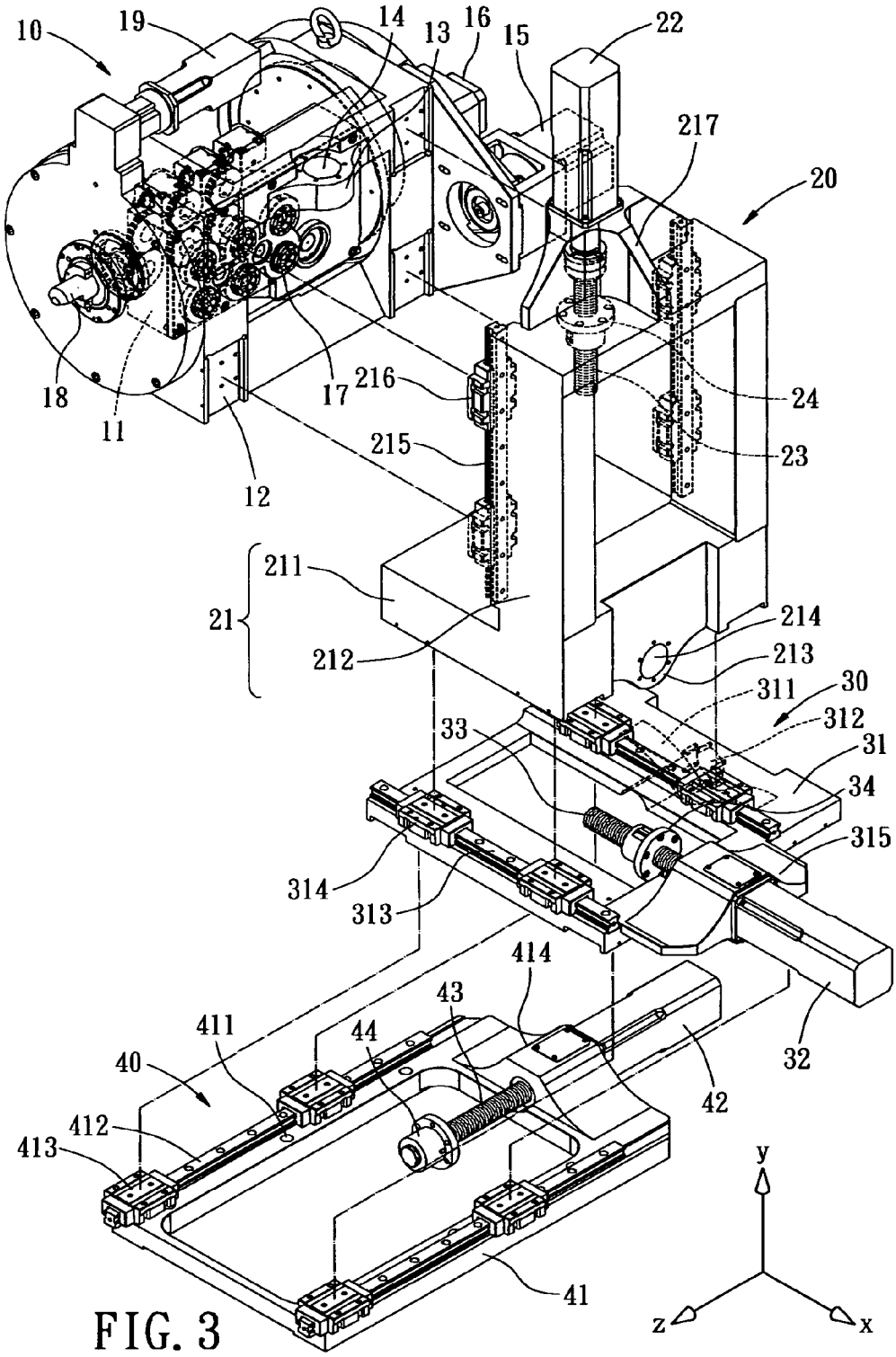
FIG. 3 is an exploded view of the second embodiment of the present invention.
Figure 4:
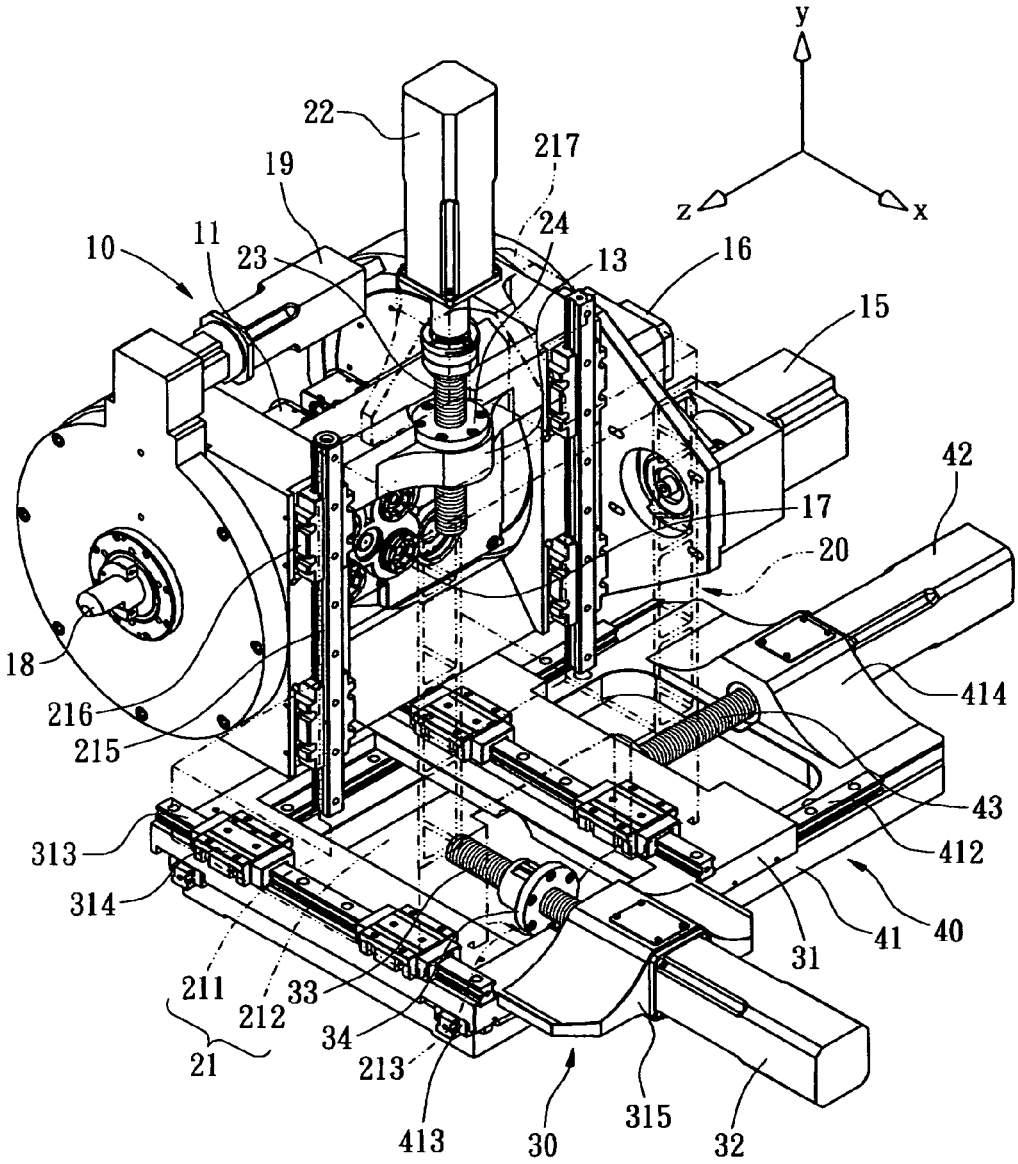
FIG. 4 is a partial perspective view of the second embodiment of the present invention.
Figure 5:
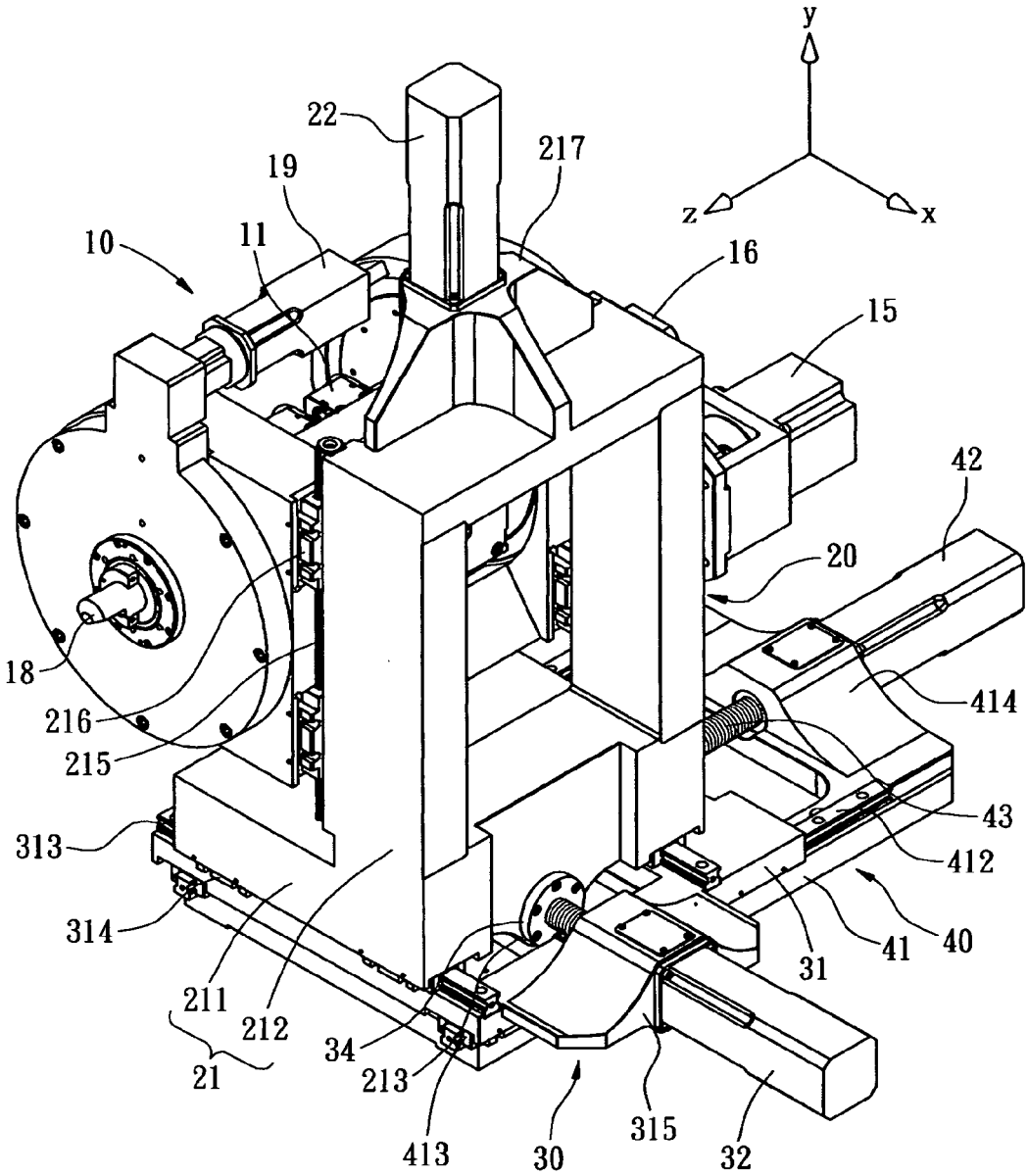
FIG. 5 is a perspective view of the second embodiment of the present invention.

Referring to FIG. 3 through FIG. 5, another embodiment of the present invention further includes a third axial driving device 40 which is installed beneath the second axial driving device 30. The third axial driving device 40 can be disposed parallel with the X axis, the Y axis, or the Z axis of the spring manufacturing machine. In the present embodiment the third axial driving device 40 is parallel with the Z axis of the spring manufacturing machine. The moving direction of the third axial driving device 40 is thereby perpendicular to those of the first and the second axial driving device 20, 30. The third axial driving device 40 is secured on the spring manufacturing machine through bolts and nuts or other means. The third axial driving device 40 is further assembled with the first and the second axial driving device 20, 30 to enable the wire feeder 10 to perform a three-dimensional movement. The third axial driving device 40 includes a Z axis base body 41, a servo motor 42, a Z axis lead screw 43, and a flange mount 44. The Z axis base body 41 has a plurality of through holes 411 formed thereon which are able to be inserted through by a plurality of bolts to secure the Z axis base body 41 onto the spring manufacturing machine, respectively. The Z axis base body 41 has parallel slide rails 412 installed on the top thereof. A plurality of slide blocks 413 are installed onto each slide rail 412. The X axis base body 31 is placed onto and connected with the slide blocks 413. Further, a fixed brace 414 is formed at and extends from one side of the Z axis base body 41. The fixed brace 414 is utilized to install the servo motor 42. The servo motor 42 has a motor shaft which is oriented toward and coupled to the Z axis lead screw 43 through a shaft coupler and other mechanical elements. The Z axis lead screw 43 is oriented parallel with the moving direction of the slide rail 412. The flange mount 44 is screwed onto the Z axis lead screw 43 with one end thereof received by the shaft hole 312 of the X axis base body 31 while the other end thereof secured on the shaft mount 311 of the X axis base body 31 through bolts or other means.

Figure 6:
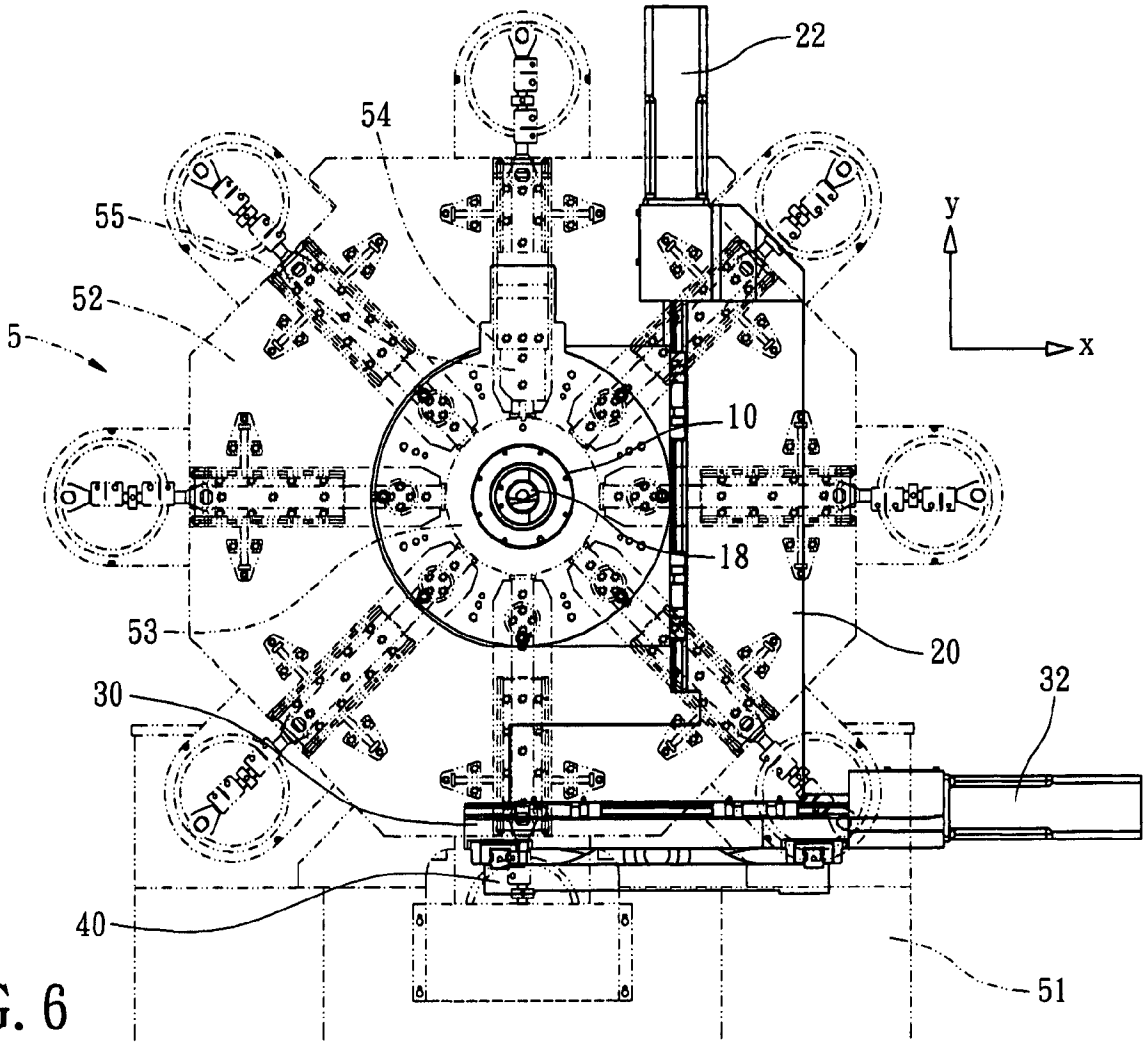
FIG. 6 is a front view of the present invention installed on a spring manufacturing machine.
Figure 7:
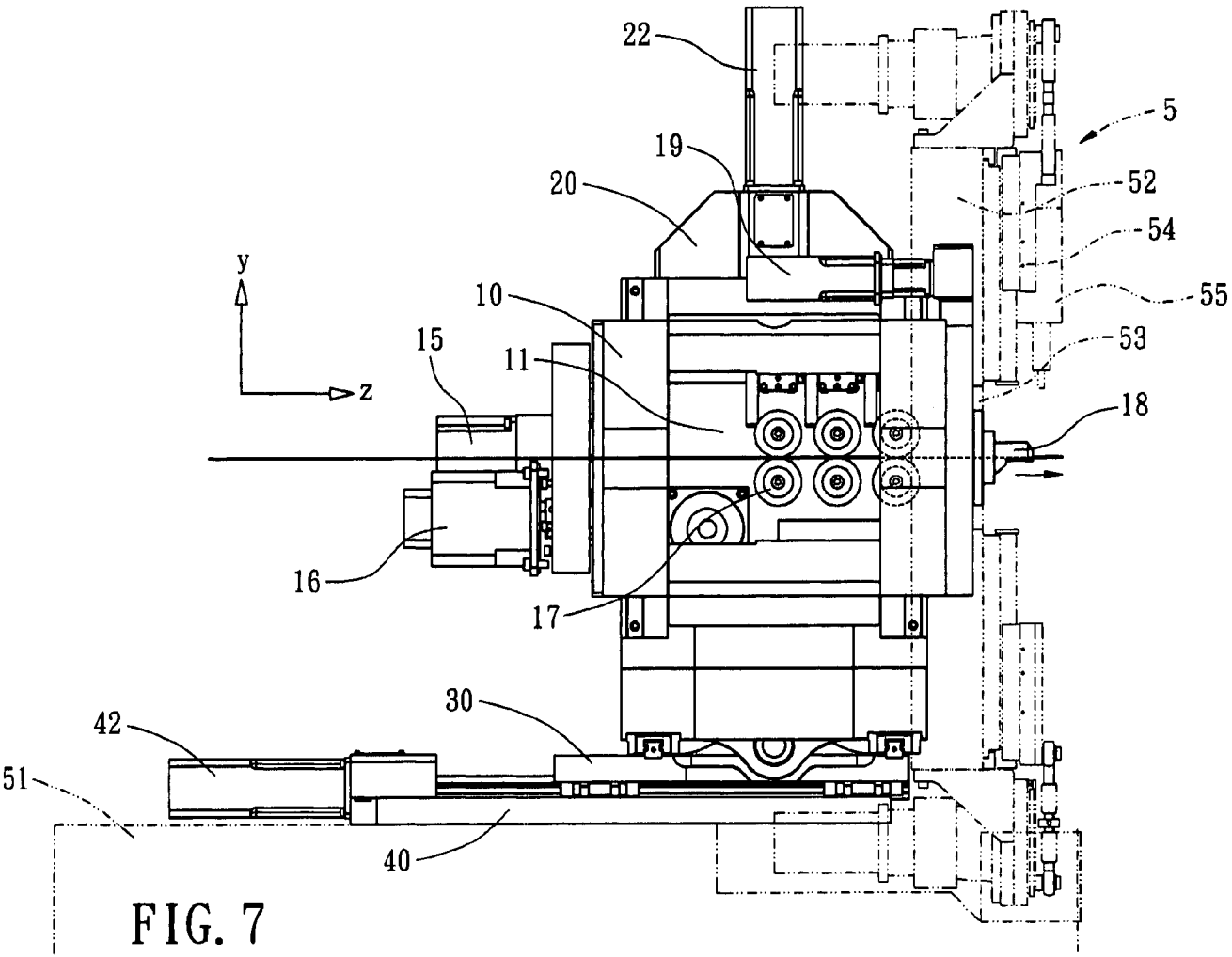
FIG. 7 is a side view of the present invention installed on a spring manufacturing machine.

Referring to FIG. 6 and FIG. 7, a wire feeder 10 and a work table 52 are assembled onto the machine base 51 of the spring manufacturing machine 5. The spring manufacturing machine 5 has the machine base 51 installed parallel with the Z axis thereof which is perpendicular to the X-Y plane. The machine base 51 is a long rectangular prism in shape. The work table 52 is installed at the front end of the machine base 51, perpendicular to the machine base 51, and oriented parallel with the X-Y plane of the spring manufacturing machine 5. The work table 52 has a circular opening 53 formed in the middle thereof. Within the circular opening 53, the feeding chuck 18 of the wire feeder 10 is able to move upward, downward, left, right, forth, or backward, or move toward a combined direction which combines with the mentioned directions. The work table 52 has a plurality of tool seats 54 mounted thereon. A variety of tool sets 55 with different functions are respectively secured to each front end of the tool seats 54. The tool set 55 is capable of moving linearly relative to the tool seat 54 or rotating through the driving of a servo motor. The linear motion of the tool set 55 enables the tool secured thereon to enter or leave the inner of the circular opening 53.

Figure 8:
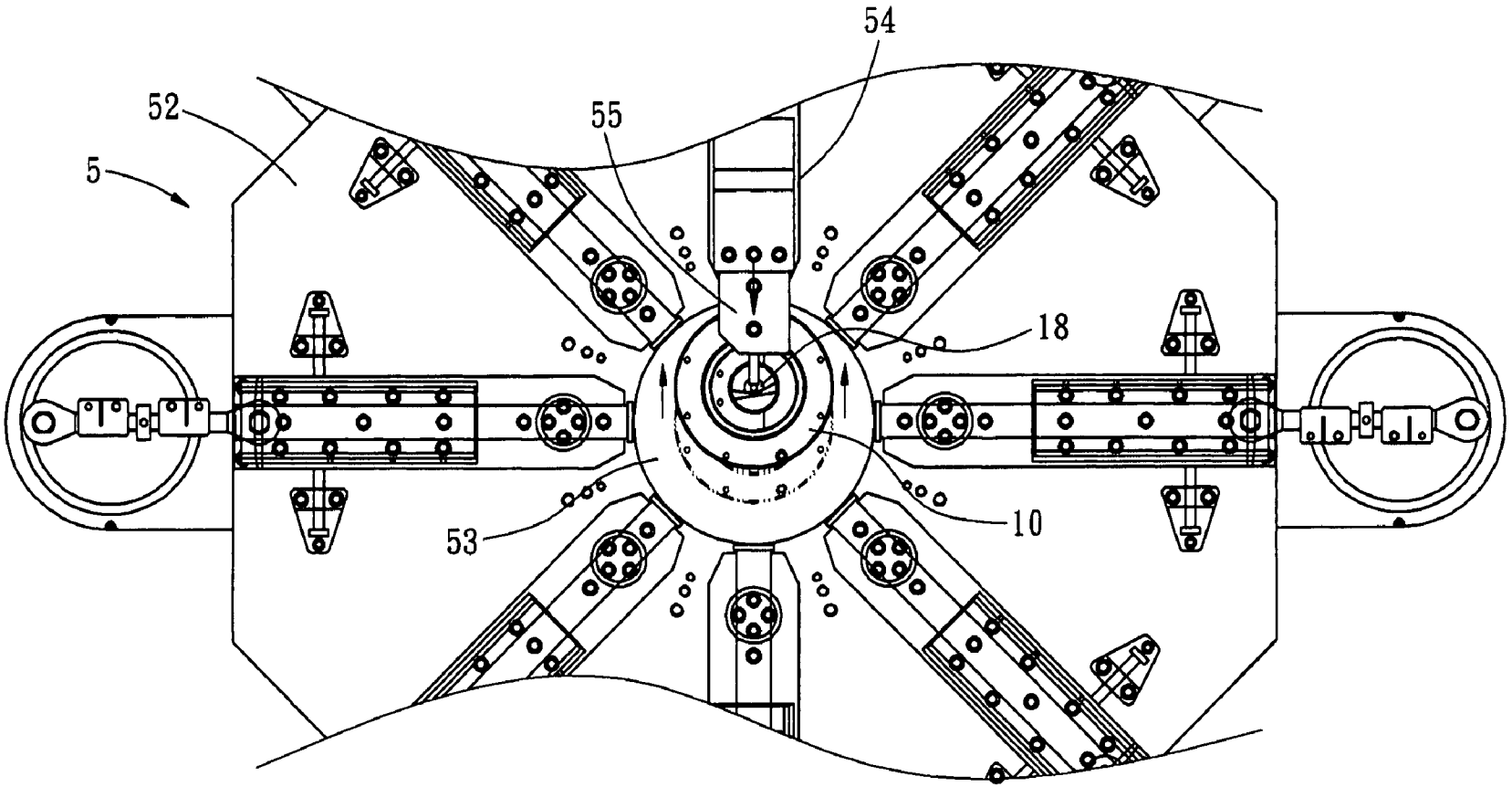
FIG. 8 is partial front view of a spring manufacturing machine illustrating the movement of the feeding chuck of the present invention.

Referring to FIG. 8, a partial front view of a spring manufacturing machine illustrates the operation of the present invention. By the actuation of a crank and linkage the tool set 55 is able to move linearly along the mounted direction of the tool seat 54 into the circular opening 53 of the work table 52. Further, the axial driving devices 20, 30, 40 enable the wire feeder 10 to perform a desired displacement. The metal wire led by the feeding chuck 18 is thereby able to approach the tool set 55 through a two-dimensional or three-dimensional movement. Accordingly, the metal wire is capable of being manufactured into various spring final products with different complicated configurations.

Figure 9A:
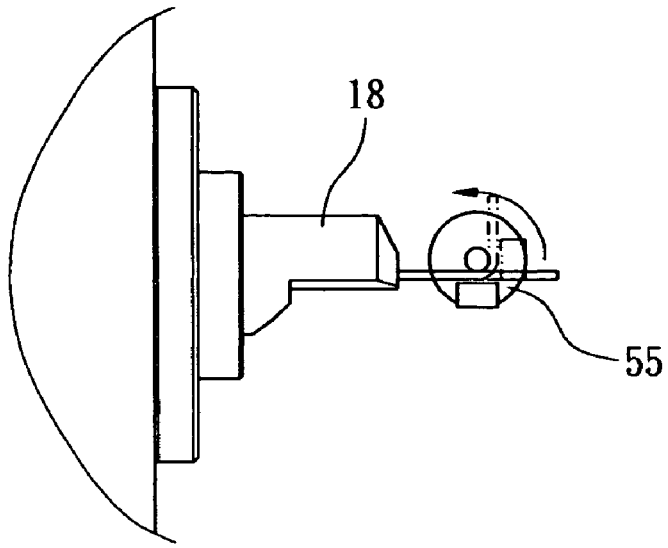
FIGS. 9A and 9B illustrate the curving process of the metal wire by utilizing the present invention.
Figure 9B:
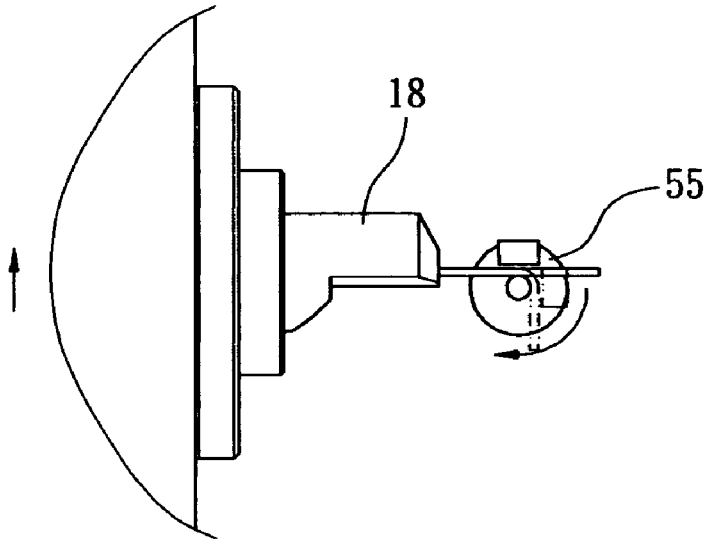
Figure 10A:
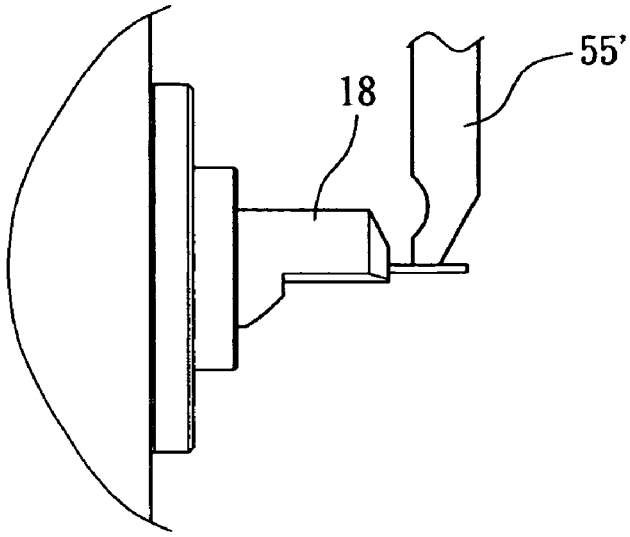
FIGS. 10A and 10B illustrate the bending process of the metal wire by utilizing the present invention.
Figure 10B:
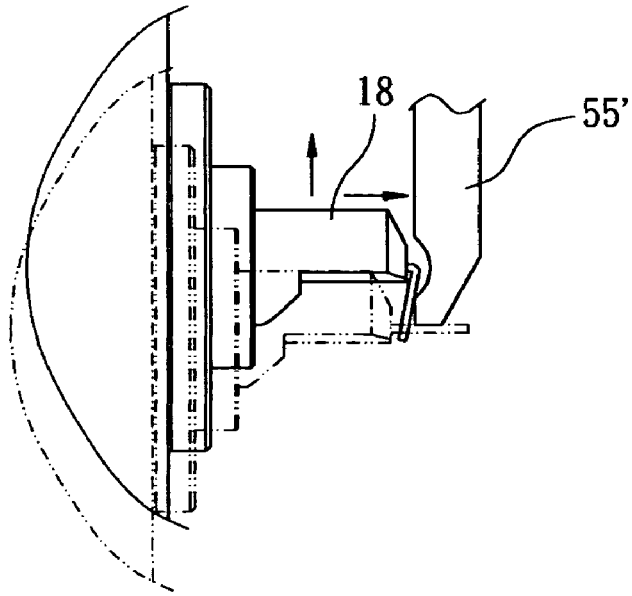
Figure 11A:
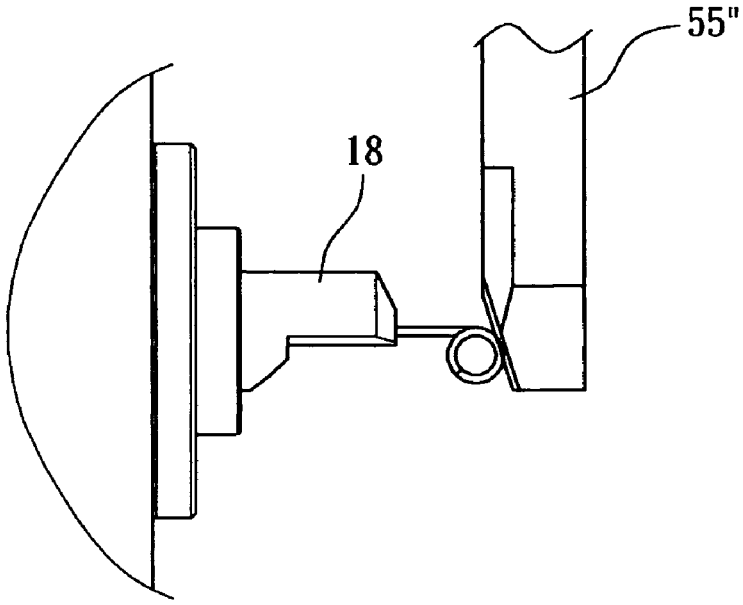
FIGS. 11A and 11B illustrate the winding process of the metal wire by utilizing the present invention.
Figure 11B:
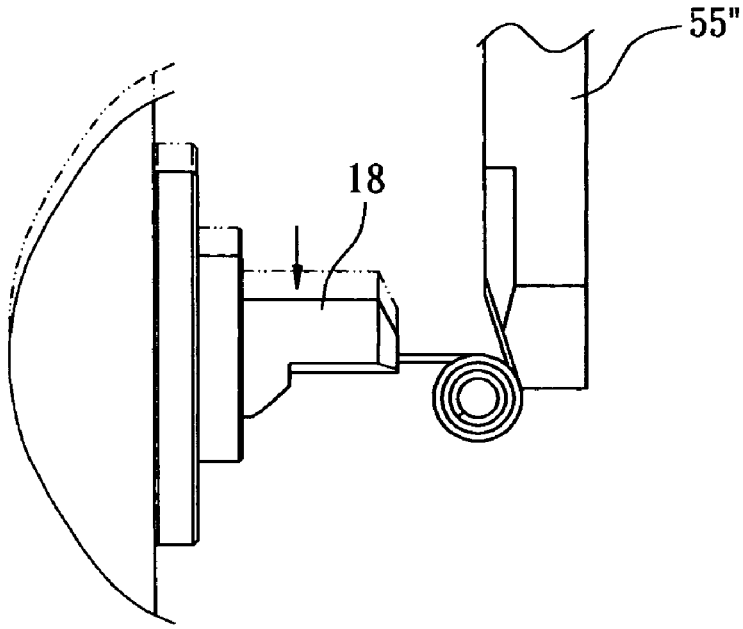

Referring to FIG. 9 through FIG. 11, to process the metal wire into springs, the spring manufacturing machine changes the position of the metal wire led by the feeding chuck 18 of the wire feeder 10 through the axial driving devices 20, 30, 40. Further utilizing the special shapes and structures of the tool set 55, the spring manufacturing machine is able to manufacture various springs with different shapes and styles. As illustrated in FIG. 9A and FIG. 9B, by the displacement of the feeding chuck 18 the metal wire is able to change its position relative to the tool set 55. Further accordingly changing the rotational direction of the tool set 55, the spring manufacturing machine is able to perform an upward curving or a downward curving. As illustrated in FIG. 10A and FIG. 10B, by utilizing a concave curve tool of the tool set 55' an upward and a forward movement of the feeding chuck 18 are able to perform a preset angle bending process to the metal wire. As illustrated in FIG. 11A and FIG. 11B, by utilizing a slope tool of the tool set 55" varying the positions of the feeding chuck 18 changes the external diameter of the spiral spring.

A wire feeder driving mechanism for a spring manufacturing machine in accordance with the present invention has at least four merits. First, the installation of the axial driving devices enable the feeding chuck of the wire feeder to perform a two-dimensional or three-dimensional approach to the tool set. This unique design exempts a spring manufacturing machine from using a complicated tool seat driving mechanism of a conventional art. The labor hours for adjustment of the tool set is thereby greatly cut down. Second, the movement of the tool set of the present invention is linear. It is easy to quantify the position point of the tool set. The replacement or adjustment of the tool set can be performed by an ordinary operator. Third, the displacement data of the axial driving devices is forward to the computer controller to automatically and precisely control the feeding chuck to perform a desired motion. It is easy to adjust the position of the feeding chuck for a desired gap between the feeding chuck and the tool set. Fourth, because the feeding chuck of the present invention is able to perform a three-dimensional motion, the usage of a tool set is more efficient than that of the prior art. The present invention therefore remedies the tool seat deficiency problem of the prior art.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A wire feeder driving mechanism secured on a work table a spring manufacturing machine so as to be assembled onto a machine base of the spring manufacturing machine, comprising:

a wire feeder having a feeding chuck and a spindle rotating motor to drive and rotate the feeding chuck;

a first axial driving device with one end connected to the wire feeder, having a first servo motor for moving the wire feeder in a first direction; and a second axial driving device with one end connected to the first axial driving device and the other end connected to the machine base, having a second servo motor for moving the first axial driving device in a second direction perpendicular to tile first direction so that the wire feeder is able to perform a two-dimensional movement of the feeding chuck within an opening of the work table.

2. The wire feeder driving mechanism of claim 1, wherein the first axial driving device moves along a vertical direction of the spring manufacturing machine while the second axial driving device moves along a horizontal direction of the spring manufacturing machine.

3. The wire feeder driving mechanism of claim 1, wherein the first axis driving device further comprises:

a first axis base body having a slide rail and a slide block installed thereon;

a fixed brace secured to one end of the first axis base body, with the first servo motor installed thereinside;

a first axis lead screw with one end inserted into the fixed brace and coupled to a shaft of the servo motor, which is oriented parallel with a moving direction of the slide block; and a flange mount screwed onto the first axis lead screw and securely connected to the wire feeder.

4. The wire feeder driving mechanism of claim 1, wherein the second axis driving device comprises:

a second axis base body secured on the machine base, having a slide rail and a slide block installed thereon;

a fixed brace secured to one end of the second axis base body, with the first servo motor installed thereinside;

a second axis load screw with one end inserted into the fixed brace and coupled to a shaft of the servo motor, which is oriented parallel with a moving direction of the slide block; and a flange mount screwed onto the second axis lead screw, and securely connected to the first axial driving device.

5. The wire feeder driving mechanism of claim 1, wherein the first axial driving device moves along a horizontal direction of the spring manufacturing machine while the second axial driving device moves along a vertical direction of the spring manufacturing machine.

6. A wire feeder driving mechanism secured on a machine base of a spring manufacturing machine, comprising:

a wire feeder having a feeding chuck;

a first axial driving device with one end connected to the wire feeder, for moving the wire feeder in a first direction;

a second axial driving device with one end connected to the first axial driving device, for moving the first axial driving device in a second direction perpendicular to the first direction; and a third axial driving device with one end connected to the second axial driving device and the other end connected to the machine base, for moving the second axial driving device in a third direction perpendicular to both the first direction and the second direction so that the wire feeder is able to perform a three-dimensional movement.

7. The wire feeder driving mechanism of claim 6, wherein the first axis driving device further comprises:

a first axis base body having a slide rail and a slide block installed thereon;

a fixed brace secured to one end of the first axis base body;

a servo motor installed inside the fixed brace;

a first axis lead screw with one end inserted into the fixed brace and coupled to a shaft of the servo motor, which is oriented parallel with a moving direction of the slide block; and a flange mount screwed onto the first axis lead screw and securely connected to the wire feeder.

8. The wire feeder driving mechanism of claim 6, wherein the second axis driving device comprises:

a third axis base body having a slide rail and a slide block installed thereon;

a fixed brace secured to one end of the third axis base body;

a servo motor installed inside the fixed brace;

a third axis lead screw with one end inserted into the fixed brace and coupled to a shaft of the servo motor, which is oriented parallel with a moving direction of the slide block; and a flange mount screwed onto the third axis lead screw, and securely connected to the second axial driving device.

9. The wire feeder driving mechanism of claim 6, wherein the second axis driving device comprises:

a second axis base body secured on the machine base, having a slide rail and a slide block installed thereon;

a fixed brace secured to one end of the second axis base body, a servo motor installed inside the fixed brace;

a second axis lead screw with one end inserted into the fixed brace and coupled to a shaft of the servo motor, which is oriented parallel with a moving direction of the slide block; and a flange mount screwed onto the second axis lead screw, and securely connected to the first axial driving device.

10. The wire feeder driving mechanism of claim 6, wherein the first axial driving device moves along a vertical direction of the spring manufacturing machine, the second axial driving device moves along a first horizontal direction of the spring manufacturing machine and the third axial driving device moves along a second horizontal direction of the spring manufacturing machine.

11. The wire feeder driving mechanism of claim 6, wherein the second axial driving device moves along a vertical direction of the spring manufacturing machine, the first axial driving device moves along a first horizontal direction of the spring manufacturing machine and the third axial driving device moves along a second horizontal direction of the spring manufacturing machine.

12. The wire feeder driving mechanism of claim 6, wherein the third axial driving device moves along a vertical direction of the spring manufacturing machine, the second axial driving device moves along a first horizontal direction of the spring manufacturing machine and the second axial driving device moves along a second horizontal direction of the spring manufacturing machine.

* * * * *